US011172306B1

(12) United States Patent
Qiu

(10) Patent No.: US 11,172,306 B1
(45) Date of Patent: Nov. 9, 2021

(54) VIBRATION SYSTEM, PANEL SPEAKER AND ACTIVE NOISE REDUCTION WEARABLE ELECTRONIC DEVICE

(71) Applicant: Shenzhen Ausounds Intelligent Co., Ltd., Shenzhen (CN)

(72) Inventor: Rui Qiu, Shenzhen (CN)

(73) Assignee: Shenzhen Ausounds Intelligent Co., Ltd., Shenzhen (CN)

( * ) Notice: Subject to any disclaimer, the term of this patent is extended or adjusted under 35 U.S.C. 154(b) by 0 days.

(21) Appl. No.: 17/077,094

(22) Filed: Oct. 22, 2020

(30) Foreign Application Priority Data

Aug. 20, 2020 (CN) ..... 202010854045.0
Aug. 20, 2020 (CN) ..... 202021776150.9

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 7/04*** | (2006.01) |
| ***H04R 1/02*** | (2006.01) |
| *H04R 3/12* | (2006.01) |

(52) U.S. Cl.
CPC ..... *H04R 7/045* (2013.01); *H04R 1/028* (2013.01); *H04R 3/12* (2013.01)

(58) Field of Classification Search
CPC ..... H04R 7/045; H04R 1/028
See application file for complete search history.

(56) References Cited

U.S. PATENT DOCUMENTS

2011/0278684 A1* 11/2011 Kasai ..... H04R 19/005 257/416
2015/0369653 A1* 12/2015 Inoue ..... H04R 19/04 381/113
2020/0275214 A1* 8/2020 Miyagawa ..... H04R 7/14

* cited by examiner

*Primary Examiner* — Simon King
(74) *Attorney, Agent, or Firm* — Westbridge IP LLC

(57) ABSTRACT

Disclosed are a vibration system, a panel speaker and an active noise reduction wearable electronic device. The vibration system includes a diaphragm body. The diaphragm body includes at least one vocalization film having a vocalization area, a reinforcement structure and a solid member. The vocalization film realizes vibration vocalization function. The reinforcement structure is provided at the vocalization area of the vocalization film to make the vocalization film remain flat at the vocalization area. The solid member is provided at other positions of the vocalization film except the vocalization area to increase strength of the diaphragm body.

18 Claims, 7 Drawing Sheets

VIBRATION SYSTEM, PANEL SPEAKER AND ACTIVE NOISE REDUCTION WEARABLE ELECTRONIC DEVICE

CROSS-REFERENCE TO RELATED APPLICATIONS

This application claims priority to Chinese Applications No. 202010854045.0 and No. 202021776150.9, both filed on Aug. 20, 2020, the entire disclosures of which are incorporated herein by reference.

TECHNICAL FIELD

The present disclosure relates to the technical field of earphone products, in particular to a vibration system, a panel speaker and an active noise reduction wearable electronic device.

BACKGROUND

Wireless Bluetooth brings better convenience to the public, and active noise reduction brings a quieter and more comfortable listening experience to the public. However, the sound quality problems of wireless Bluetooth, such as sound distortion and low sensitivity, are often mentioned by many users during the process of using wireless Bluetooth active noise reduction earphones, which are the pain points of current users.

Panel speakers have the characteristics of large effective vibration area, small segmentation vibration, short distance between magnet and diaphragm, high magnetic field density, etc., which make it have the advantages of low distortion, fast transient, wide frequency response range, and fine details in sound performance. Therefore, the panel speakers are widely used in electronic devices such as monitor headphones (a form of wired earphone) and HiFi earphone (a form of wired earphone), and are popular among earphone enthusiasts.

However, traditional flat speakers have high F0 (the lowest resonant frequency of the speaker, F0 for short), and the diaphragm is easy to deform, resulting in poor product consistency and not meeting the debugging requirements of noise reduction headphones. Therefore, flat speakers have not yet been successfully applied to actual products on active noise reduction Bluetooth headphones. The successful adaptation of the flat speaker to the active noise reduction Bluetooth headphones still has technical problems waiting to be overcome.

SUMMARY

The main objective of the present disclosure provides a vibration system, a panel speaker and an active noise reduction wearable electronic device, which aims to solve the problem that the diaphragm of traditional panel speakers is easy to deform, F0 is high, and product consistency is poor, which makes it difficult to apply panel speakers to active noise reduction headphones, and solve the problem of high production defect rate during the process of producing, processing and assembling the vocalization film of the panel speaker.

In order to achieve the above objective, the present disclosure provides a vibration system, including a diaphragm body, the diaphragm body including: at least one vocalization film having a vocalization area; a reinforcement structure provided at the vocalization area of the vocalization film to make the vocalization film remain flat at the vocalization area; and a solid member provided at other positions of the vocalization film except the vocalization area to increase strength of the diaphragm body.

In an embodiment, a plurality of vocalization films are laminated in a thickness direction, and the plurality of vocalization films include a first film and at least one second film provided on each side of the first film; and the reinforcement structure is provided at a vocalization area of the first film, and a vocalization area of the at least one second film is hollowed out.

In an embodiment, the solid member is in a sheet shape and is provided at other positions of the at least one second film except the vocalization area.

In an embodiment, the solid member is a steel sheet.

In an embodiment, a thickness of the steel sheet is between 0.2 mm and 0.6 mm.

In an embodiment, two adjacent vocalization films are bonded and fixed through damping glue, and the vocalization film and the reinforcement structure are bonded and fixed through damping glue.

In an embodiment, a thickness of the damping glue is between 11μm and 15 μm.

In an embodiment, the reinforcement structure includes a first reinforcement structure and a second reinforcement structure provided on opposite sides of the vocalization film.

In an embodiment, both the first reinforcement structure and the second reinforcement structure are made of copper foil.

In an embodiment, the second reinforcement structure is electrically connected to a conductive terminal of the vibration system.

In an embodiment, the first reinforcement structure includes a first copper wire portion in a grid pattern at the vocalization area of the vocalization film.

In an embodiment, the second reinforcement structure includes a second copper wire portion formed by bending multiple times at the vocalization area of the vocalization film.

In an embodiment, a thickness of the vocalization film is between 9 μm and 15 μm.

In an embodiment, a thickness of the reinforcement structure is between 15 μm and 20 μm.

Besides, in order to achieve the above objective, the present disclosure further provides a panel speaker, including a vibration system, the vibration system including a diaphragm body, the diaphragm body including: at least one vocalization film having a vocalization area; a reinforcement structure provided at the vocalization area of the vocalization film to make the vocalization film remain flat at the vocalization area; and a solid member provided at other positions of the vocalization film except the vocalization area to increase strength of the diaphragm body.

In an embodiment, the panel speaker further includes a bottom case, one side of the bottom case is provided with an installation groove for installing the vibration system, and another side of the bottom case is provided with a guide pipe structure communicating with the installation groove.

Besides, in order to achieve the above objective, the present disclosure further provides an active noise reduction wearable electronic device including the panel speaker as described above.

In an embodiment, the active noise reduction wearable electronic device is an active noise reduction earphone.

In technical solutions of the present disclosure, the lamination of one first film and two second films can increase the thickness of the diaphragm body, thereby increasing the rigidity of the diaphragm body. The grid-shaped first reinforcement structure and the second reinforcement structure formed by bending multiple times can effectively prevent the diaphragm body from wrinkling. The steel sheet can increase the strength of the diaphragm body, thereby effectively solving the problem of wrinkling of the diaphragm body. Multiple vocalization films, the reinforcement structure, and the steel sheet can increase the weight of the diaphragm body; the hollowing out of the vocalization area of the second film reduces the thickness of the vocalization film and limits the thickness of the damping glue, both of which can improve the compliance of the diaphragm body and help reduce F0. In addition, the guide tube structure can reduce the F0 of the entire active noise reduction earphone and enhance the low frequency energy.

BRIEF DESCRIPTION OF THE DRAWINGS

In order to more clearly illustrate the embodiments of the present disclosure, drawings used in the embodiments will be briefly described below. Obviously, the drawings in the following description are only some embodiments of the present disclosure. It will be apparent to those skilled in the art that other figures can be obtained according to the structures shown in the drawings without creative work.

DETAILED DESCRIPTION OF THE EMBODIMENTS

Figure 1:
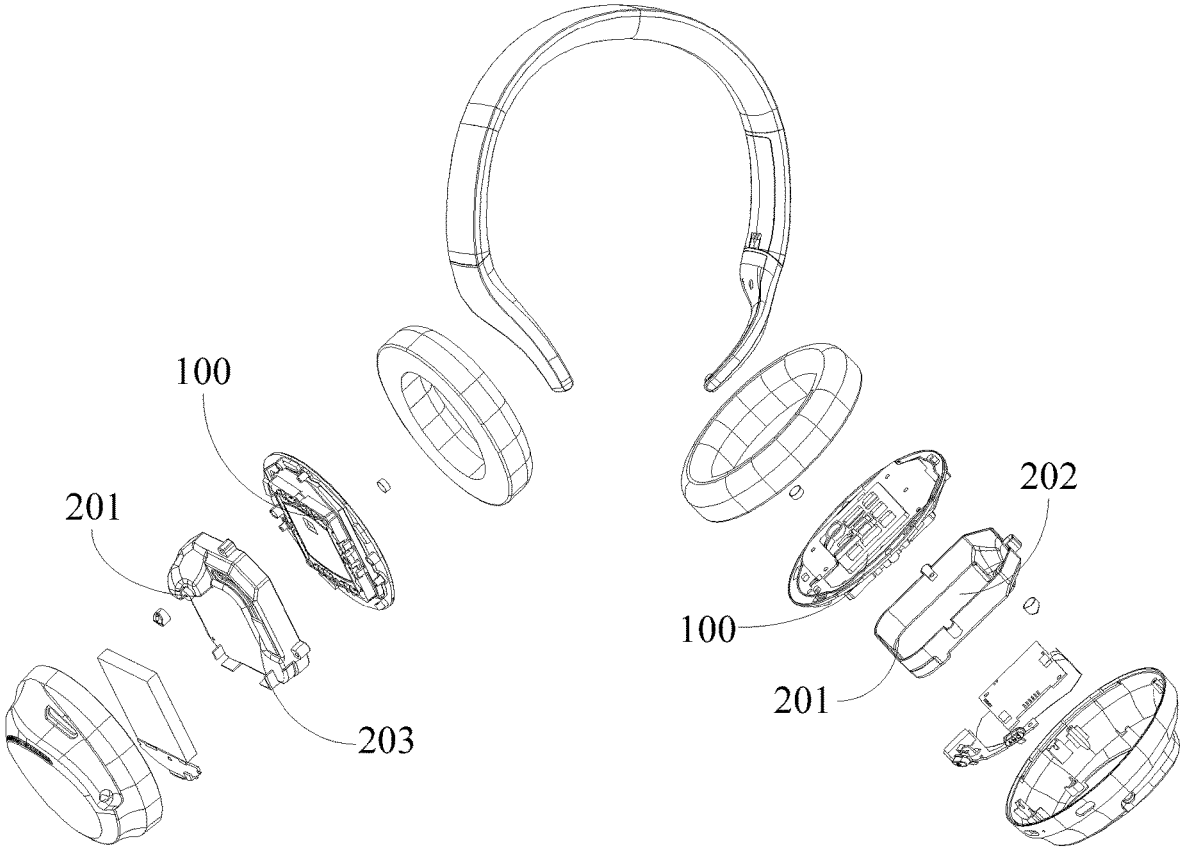
FIG. 1 is a schematic perspective view of an active noise reduction headphone according to an embodiment of the present disclosure.

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that if there is a directional indication (such as up, down, left, right, front, rear . . . ) in the embodiments of the present disclosure, the directional indication is only used to explain the relative positional relationship, movement, etc. of the components in a certain posture (as shown in the drawings). If the specific posture changes, the directional indication will change accordingly.

Besides, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. The meaning of "and/or" appearing in the disclosure includes three parallel scenarios. For example, "A and/or B" includes only A, or only B, or both A and B. In addition, the technical solutions between the various embodiments can be combined with each other, but it must be based on what can be achieved by a person of ordinary skill in the art. When the combination of technical solutions is contradictory or cannot be achieved, it should be considered that such a combination of technical solutions does not exist, nor does it fall within the scope of the present disclosure.

Figure 2:
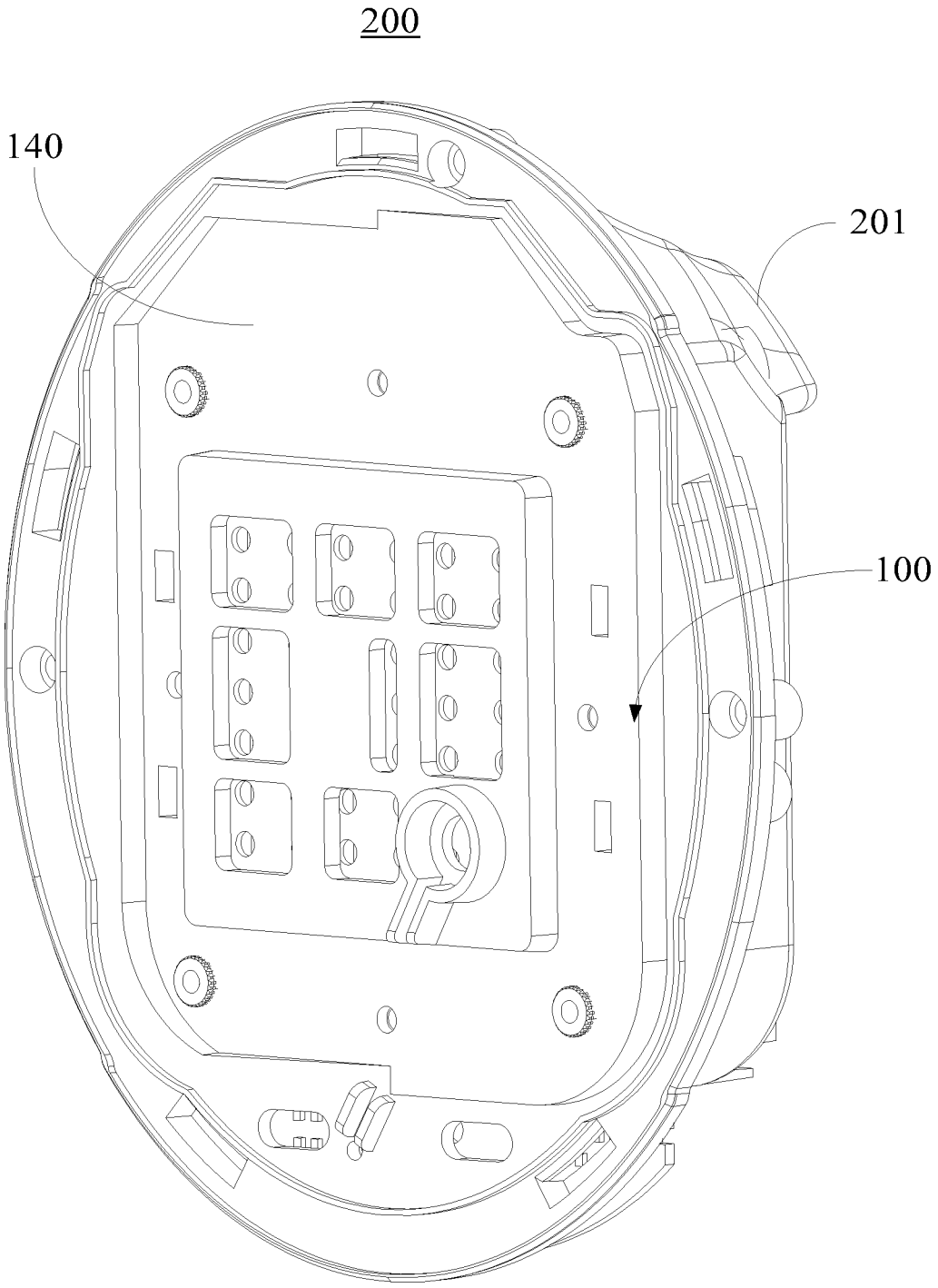
FIG. 2 is a schematic perspective view of a panel speaker according to an embodiment of the present disclosure.
Figure 3:
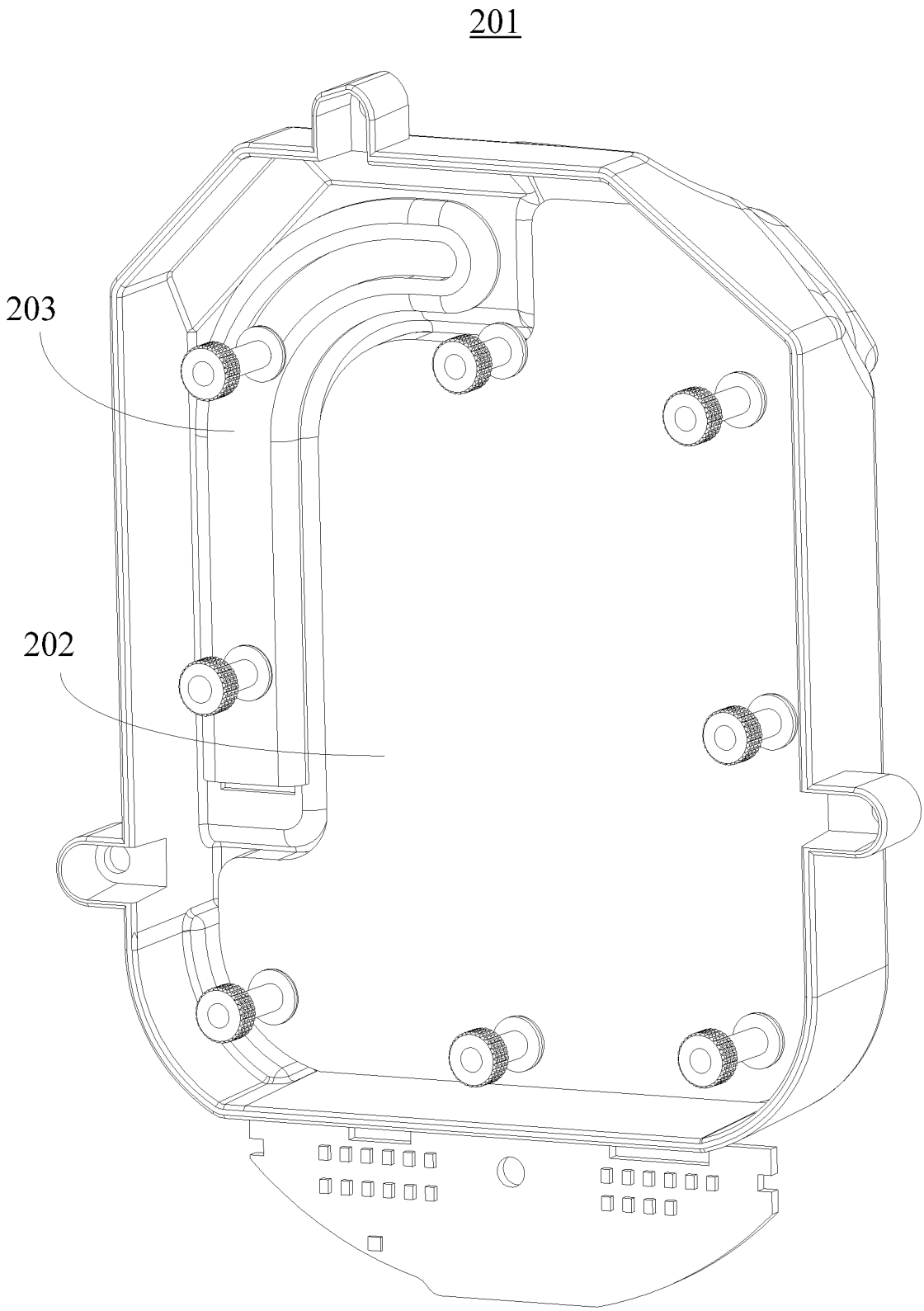
FIG. 3 is a schematic structural diagram of a bottom case in FIG. 1 viewed from a perspective.
Figure 4:
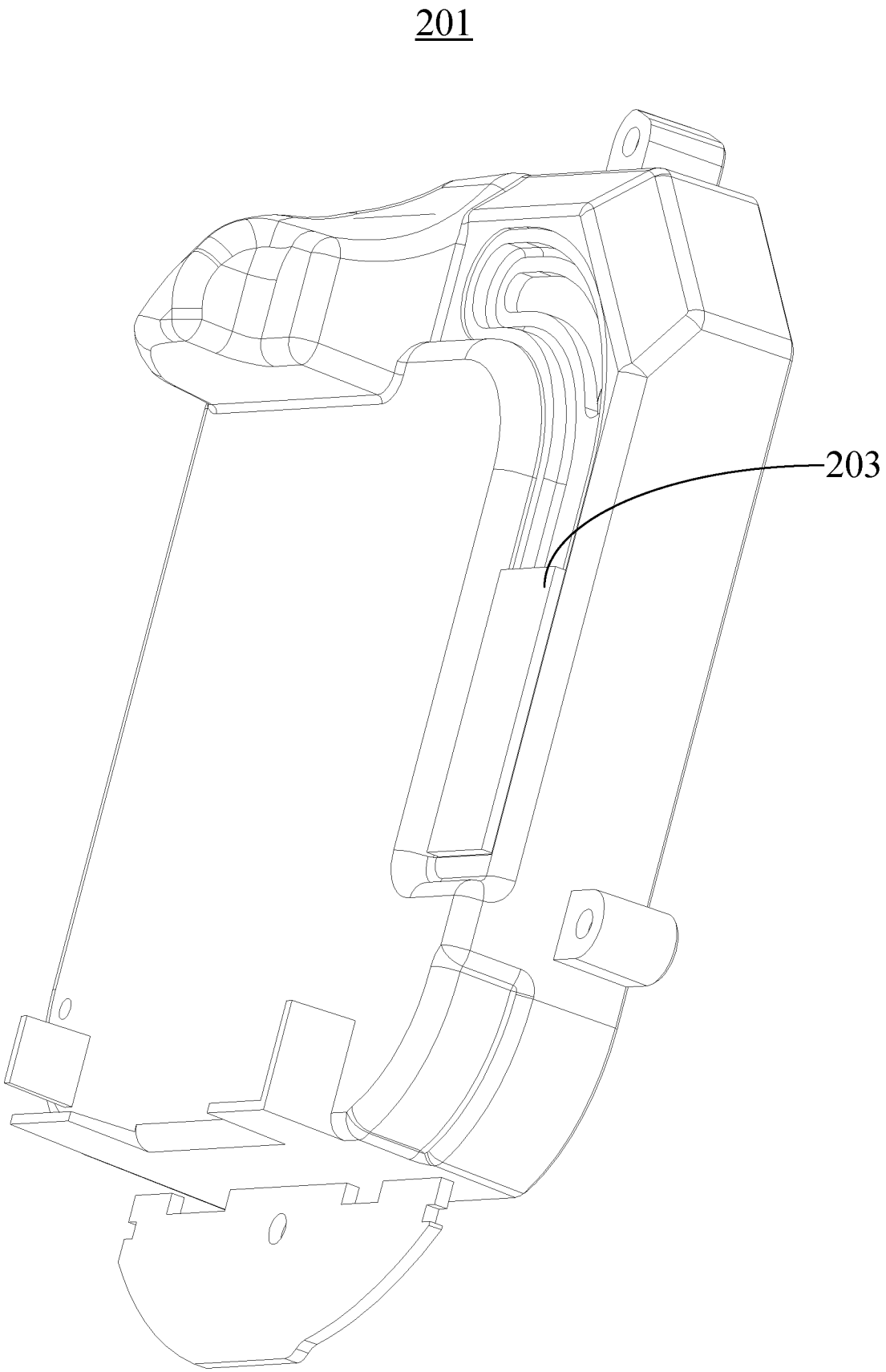
FIG. 4 is a schematic structural diagram of the bottom case in FIG. 1 viewed from another perspective.
Figure 5:
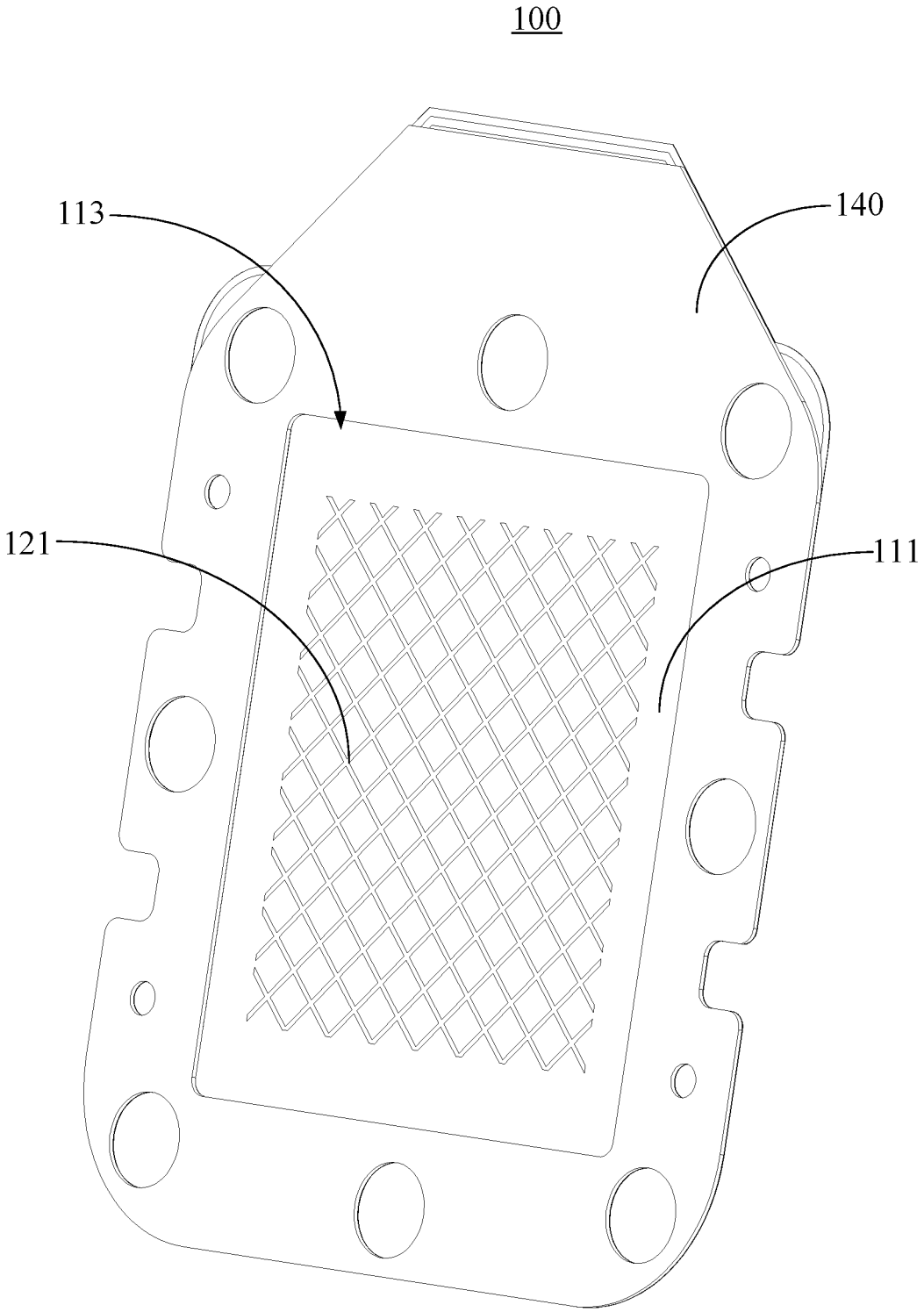
FIG. 5 is a schematic structural diagram of a diaphragm body in FIG. 1 viewed from a perspective.
Figure 6:
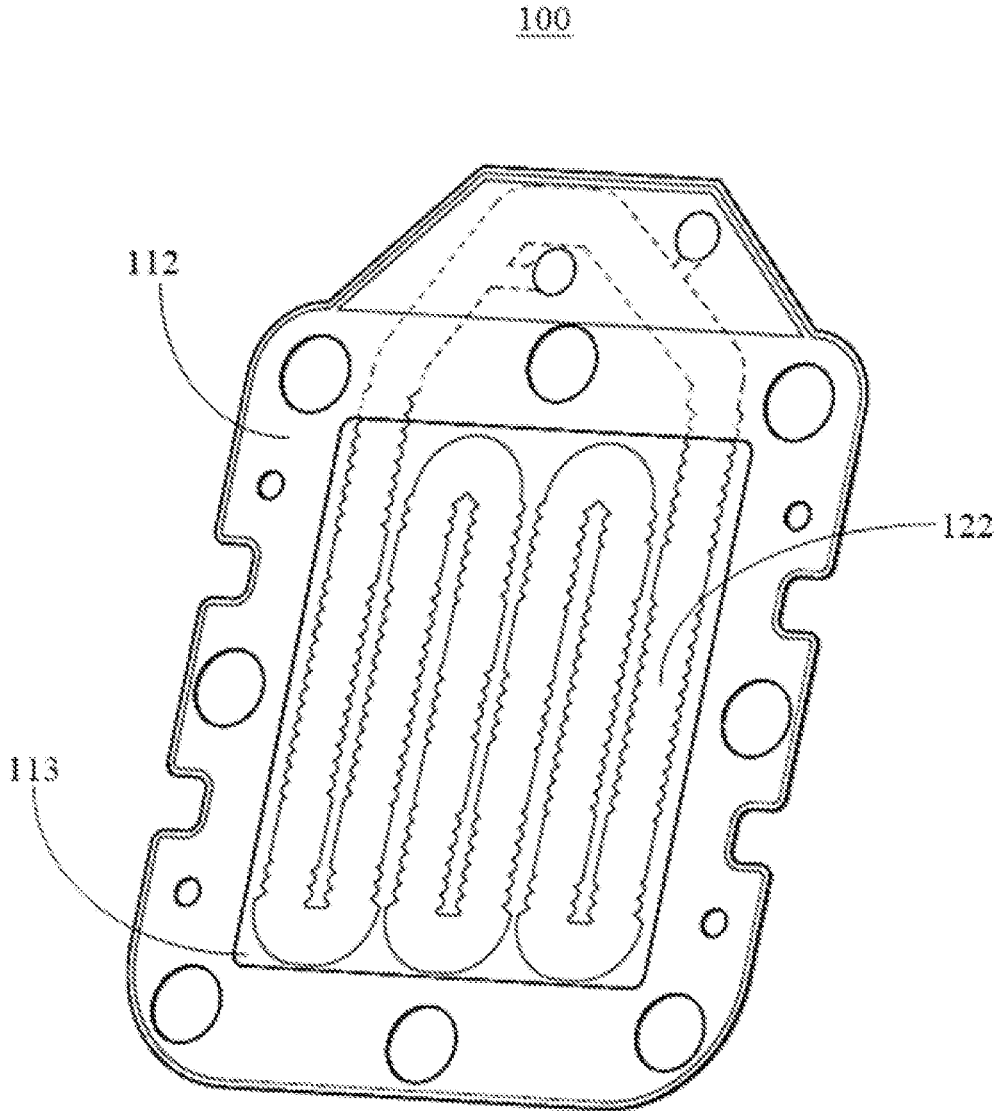
FIG. 6 is a schematic structural diagram of the diaphragm body in FIG. 1 viewed from another perspective.

The present disclosure provides an active noise reduction wearable electronic device. The active noise reduction wearable electronic device may be a smart bracelet, a smart watch or an active noise reduction earphone, etc. For ease of understanding, as shown in FIG. 1, the following embodiments are described by taking the active noise reduction wearable device as an active noise reduction earphone as an example. The active noise reduction wearable electronic device includes a panel speaker, and specific embodiments of the panel speaker are shown in FIG. 2 to FIG. 4.

Specially, a panel speaker 200 generally includes a vibration system and a magnetic circuit structure. The main working principle of the panel speaker 200 is: the vibration system generally includes a diaphragm structure and a voice coil structure. When the voice coil structure passes through an audio current amplified by a power amplifier, the audio variable magnetic flux generated by the audio current in the magnetic circuit structure acts on the diaphragm structure and generates a mutual induction magnetic field with a conductive structure in the diaphragm structure. The mutual induction magnetic field interacts with the audio magnetic field to make the diaphragm structure vibrate and produce sound. For details, refer to the prior art, which is not limited here. The magnetic circuit structure may be a dual magnetic circuit structure, and the magnet may be made of high-performance N52 neodymium iron boron, which helps to improve sensitivity and reduce distortion. The impedance of the vibration system can be 32 ohms, which helps to improve Sound Pressure Level (SPL).

The vibration system according to the present disclosure includes a diaphragm body 100. The diaphragm body 100 includes at least one vocalization film, a reinforcement structure and a solid member. The vocalization film has a vocalization area 113. The reinforcement structure is provided at the vocalization area 113 of the vocalization film to make the vocalization film remain flat at the vocalization area 113. The solid member is provided at other positions of the vocalization film except the vocalization area 113. The reinforcement structure and the solid member help reduce the overall deformation of the vocalization film, thereby reducing the distortion of the diaphragm body 100, and can improve product consistency, which is beneficial to the production and assembly of the diaphragm body 100, and helps to improve the production yield.

It should be understood that the panel speaker 200 replaces a cone in a cone speaker with the relatively flat diaphragm body 100, which can eliminate the cavity effect of the cone speaker, such that when the voice coil structure pushes the diaphragm body 100, the diaphragm body 100 can emit sound radiation with a more uniform distribution, bring a flatter frequency response, and obtain a wider vibration range, thereby reducing distortion in a bandwidth frequency band.

In order to achieve the above objective, the diaphragm body 100 of the panel speaker 200 should have good rigidity.

There are many ways to improve the rigidity of the diaphragm body 100.

In this embodiment, a reinforcement structure is provided at the vocalization area 113 of the vocalization film to ensure that the vocalization film remains flat during use, which can avoid the problem of reducing the effective vibration area of the vocalization film due to the wrinkles of the vocalization film, causing distortion and reducing product consistency. In addition, the arrangement of the reinforcement structure can increase the weight of the diaphragm body 100 to an extent, thereby helping to reduce F0.

Figure 7:
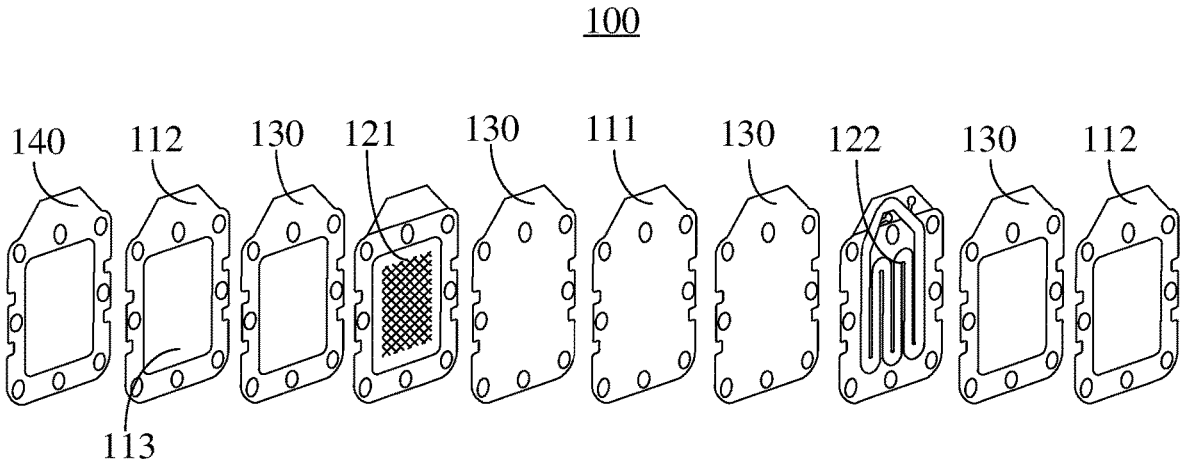
FIG. 7 is an exploded schematic diagram of the diaphragm body in FIG. 5.

As shown in FIG. 7, in an embodiment, the reinforcement structure includes a first reinforcement structure 121 and a second reinforcement structure 122 provided on opposite sides of the vocalization film. Both the first reinforcement structure 121 and the second reinforcement structure 122 are made of copper foil. The second reinforcement structure 122 is electrically connected to a conductive terminal of the vibration system. The copper foil has sufficient strength and good electrical conductivity. Both the first reinforcement structure 121 and the second reinforcement structure 122 are made of copper foil, which helps to simplify the processing of the reinforcement structure. The second reinforcement structure 122 is equivalent to the above-mentioned conductive structure constituting the vibration system, and will not be described in detail here.

Further, in an embodiment, setting the first reinforcement structure 121 as a first copper wire portion is equivalent to providing a reinforcement rib at the vocalization area 113 of the first film 111, which can achieve the above-mentioned strengthening effect. In other embodiments, the first copper wire portion may be in a grid shape or be scattered in dots at the vocalization area 113 of the first film 111. However, based on multiple analyses and tests, the first reinforcement structure 121 is in a grid pattern, which has a better effect on improving the sensitivity of the diaphragm body 100 and reducing the distortion of the first film 111. In detail, the grid shape can enhance the rigidity of the entire diaphragm body 100 when vibrating, and can synchronize the amplitude of the entire grid surface and reduce the distortion of the speaker. This method can meet the requirements of lightness (less materials) and rigidity required by the diaphragm body 100. The grid shape may be a circular mesh, a diamond mesh or other polygonal meshes. The coverage of the first reinforcement structure 121 at the vocalization area 113 of the first film 111 can be adjusted according to actual needs. For example, it is set to cover the entire film surface of the vocalization area 113, or it can be set to cover a part of the film surface of the vocalization area 113.

It should be noted that the specific formation method of the copper foil layer in a grid pattern is not limited in this design. For example, the entire copper foil film layer can be bonded and fixed to the vocalization area 113 of the first film 111 through the damping glue 130. Then, the grid structure is formed by etching, developing, etc., which is easier to process and shape, and helps to strengthen the connection strength between the first reinforcement structure 121 and the first vocalization film.

In an embodiment, the second reinforcement structure 122 includes a second copper wire portion formed by bending multiple times at the vocalization area 113. The second copper wire portion keeps the first film 111 flat, and also plays a conductive role. If the routing paths of the second copper wire portion are staggered and complicated, it is not conducive to the conductive function of the second copper wire portion. Therefore, in this embodiment, the second copper wire portion is configured to be bent multiple times at the vocalization area 113. Specifically, the second copper wire portion includes a plurality of curved sections and a plurality of straight sections. The opposite ends of each curved section are respectively connected to the straight section to form a bent conductive path, which can take into account the reinforcement function and the conductive function of the second reinforcement structure 122.

In an embodiment, a plurality of vocalization films are laminated in a thickness direction, and the plurality of vocalization films include a first film 111 and at least one second film 112 provided on both sides of the first film 111. The plurality of vocalization films are stacked in one direction in sequence, which can effectively increase the overall thickness of the diaphragm body 100 while maintaining the overall shape of the diaphragm body 100. If the number of the laminated vocalization films is too small, the purpose of improving rigidity cannot be achieved. If the number of laminated vocalization films is too large, the mass of the diaphragm body 100 is likely to increase, which affects the vocalization effect. Therefore, in a specific embodiment, the number of the first film 111 may be one, and the number of the second film 112 may be two.

A vocalization area 113 of the second film 112 is hollowed out. Since the first film 111 plays the main vocalization function, the second film 112 plays the auxiliary vocalization function and is used to improve the rigidity of the diaphragm body 100. Therefore, the vocalization area 113 of the second film 112 can be hollowed out without increasing the thickness of the diaphragm body 100 at the vocalization area 113. The second film 112 can be used to clamp and limit the first film 111 to improve the rigidity at other positions of the first film 111 except the vocalization area 113, and to avoid deformation at this position. Furthermore, in combination with the solution of arranging the above-mentioned reinforcement structure in the vocalization area 113 of the first film 111, it helps to enhance the overall rigidity of the first film 111 and avoid the deformation of the entire film body.

The solid member is used to strengthen the overall strength of the diaphragm body 100, but does not affect the normal vocalization of the first film 111. Therefore, in an embodiment, the solid member is in a sheet shape and is provided at other positions of the second film 112 except the vocalization area 113. The sheet-shaped solid member can reduce the space occupation of the solid member, thereby reducing the overall thickness of the diaphragm body 100. The sheet-shaped solid member and the vocalization film are more closely attached, which helps to increase the connection area between the two as much as possible and improve the overall strength of the diaphragm body 100. Providing the solid member on the second film 112 can reduce interference with the vocalization area 113 of the first film 111, thereby ensuring the vocalization effect and quality of the diaphragm body 100.

Further, in an embodiment, the solid member is a steel sheet 140. The steel sheet 140 can provide sufficient strength while forming a relatively small size and thickness to ensure that the diaphragm body 100 is not deformed.

In an embodiment, the steel sheet 140 is hot-pressed and fixed on the second film 112 through the damping glue 130. That is, the steel sheet 140 and the second film 112 are fixedly connected by hot pressing and bonding, which is easier to operate, thereby improving the production efficiency and reducing the defect rate while improving the consistency of the product phase and frequency response.

When the diaphragm body 100 is specifically applied to an active noise reduction earphone, the diaphragm body 100 includes two second films 112 and a first film 111 interposed therebetween. A first reinforcement structure 121 in a grid pattern and a second reinforcement structure 122 formed by bending multiple times are respectively formed on opposite sides of the first film 111. The adjacent vocalization film and the reinforcement structure are bonded and fixed through the damping glue 130. In addition, a steel sheet 140 is provided on the second film 112 close to the first reinforcement structure 121 and opposite to the first film 111.

As shown in FIG. 7, in an embodiment, a thickness of the vocalization film is between 9 μm and 15 μm. It can be understood that if the thickness of the vocalization film is too thick, the overall thickness of the diaphragm body 100 is easily increased, which is not conducive to vibration and sound generation of the vocalization film. If the thickness of the vocalization film is too thin, the overall rigidity of the diaphragm body 100 is likely to be reduced, and the vocalization film is likely to be deformed or even damaged during use. When the thickness of the vocalization film is between 9 μm and 15 μm, especially when the thickness of the vocalization film is 12 μm, it helps to improve the sound quality and reduce the deformation of the vocalization film.

A thickness of the reinforcement structure is between 15 μm and 20 μm. It should be noted that when the reinforcement structure includes the first reinforcement structure 121 and the second reinforcement structure 122, both thicknesses of the first reinforcement structure 121 and the second reinforcement structure 122 are between 15 μm and 20 μm, and further 18 μm, which helps increase the strength of the diaphragm body 100 and increase low frequency energy. Both thicknesses of the first reinforcement structure 121 and the second reinforcement structure 122 are 18 μm, and made of copper, which can increase the weight and strength of the diaphragm body 100 and increase low frequency energy. Setting the first reinforcement structure 121 in a grid shape can solve the problem of distortion and consistency caused by the deformation of the diaphragm body 100, thereby ensuring the quality of the diaphragm body, and increasing the production and processing yield of products.

In an embodiment, two adjacent vocalization films are bonded and fixed through damping glue 130, and the vocalization film and the reinforcement structure are bonded and fixed through damping glue 130, such that the film layers of the diaphragm body 100 are firmly connected to form an integral. A thickness of the damping glue 130 between the vocalization film and the reinforcement structure is between 11μm and 15 μm. Further, the thickness of the damping glue 130 between the vocalization film and the reinforcement structure is 13 μm, the thickness of the diaphragm body 100 can be balanced as much as possible, and the connection stability between the vocalization film and the reinforcement structure can be enhanced, which helps to improve the sound quality and reduce the deformation of the vocalization film, and also helps to reduce F0 by improving the compliance of the diaphragm body 100.

In an embodiment, a thickness of the steel sheet is between 0.2 mm and 0.6 mm. Further, the thickness of the steel sheet is 0.5 mm. If the thickness of the steel sheet 140 is too large, the overall thickness of the diaphragm body 100 is directly increased, and the vibration effect of the first film 111 is affected, and the sound quality of the diaphragm body 100 is easily reduced. If the thickness of the steel sheet 140 is too small, the strengthening effect of the steel sheet 140 will be weakened, and the problem of easy deformation of the vocalization film cannot be overcome. It is determined through experiments that the thickness of the steel sheet 140 is between 0.2 mm and 0.6 mm, especially 0.5 mm, which can take into account the consideration of size and strength, thereby better improving product phase and frequency response consistency, and better improving the production yield.

As shown in FIG. 2 to FIG. 4, the panel speaker 200 further includes a bottom case 201, one side of the bottom case 201 is provided with an installation groove 202 for installing the vibration system and the magnetic circuit structure, and another side of the bottom case 201 is provided with a guide pipe structure 203 communicating with the installation groove 202. The guide tube structure 203 is a bass guide tube structure 203, which helps to improve low frequency energy and reduce F0 to achieve the low frequency required for noise reduction. The guide tube structure 203 extends along the bottom of the bottom case 201, and two ends of the guide tube structure 203 respectively communicate with the installation groove 202 and an external environment of the bottom case 201. The guide tube structure 203 may be a tubular structure formed directly on the bottom case 201. Alternatively, a groove-shaped structure may be recessed on the outer bottom wall of the bottom case 201, and then a cover structure may be covered at least part of the notches of the groove-shaped structure. The groove-shaped structure and the cover structure jointly form the guide tube structure 203.

In summary, there are two major difficulties when applying the panel speaker 200 to active noise reduction earphones. One is that the diaphragm body 100 is prone to wrinkles, and the other is that F0 is relatively high.

In view of the wrinkle problem of the diaphragm body 100: when the diaphragm body 100 becomes wrinkled, it is easy to cause more sound distortion and poor product consistency. Therefore, in the embodiment of the present disclosure, the lamination of one first film 111 and two second films 112 can increase the thickness of the diaphragm body 100, thereby increasing the rigidity of the diaphragm body 100. The grid-shaped first reinforcement structure 121 and the second reinforcement structure 122 formed by bending multiple times can effectively prevent the diaphragm body 100 from wrinkling. The steel sheet 140 can increase the strength of the diaphragm body 100, thereby effectively solving the problem of wrinkling of the diaphragm body.

In view of the problem of high F0, in the embodiment of the present disclosure, multiple vocalization films, the reinforcement structure, and the steel sheet 140 can increase the weight of the diaphragm body 100; the hollowing out of the vocalization area of the second film 112 reduces the thickness of the vocalization film and limits the thickness of the damping glue, both of which can improve the compliance of the diaphragm body 100 and help reduce F0. In addition, the guide tube structure can reduce the F0 of the entire active noise reduction earphone and enhance the low frequency energy.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A vibration system, comprising a diaphragm body, the diaphragm body comprising:

at least one vocalization film having a vocalization area;

a reinforcement structure provided at the vocalization area of the vocalization film to make the vocalization film remain flat at the vocalization area; and a solid member provided at other positions of the vocalization film except the vocalization area to increase strength of the diaphragm body.

2. The vibration system of claim 1, wherein:

a plurality of vocalization films are laminated in a thickness direction, and the plurality of vocalization films comprise a first film and at least one second film provided on each side of the first film; and the reinforcement structure is provided at a vocalization area of the first film, and a vocalization area of the at least one second film is hollowed out.

3. The vibration system of claim 2, wherein the solid member is in a sheet shape and is provided at other positions of the at least one second film except the vocalization area.

4. The vibration system of claim 1, wherein the solid member is a steel sheet.

5. The vibration system of claim 4, wherein a thickness of the steel sheet is between 0.2 mm and 0.6 mm.

6. The vibration system of claim 2, wherein two adjacent vocalization films are bonded and fixed through damping glue, and the vocalization film and the reinforcement structure are bonded and fixed through damping glue.

7. The vibration system of claim 6, wherein a thickness of the damping glue is between 11μm and 15 μm.

8. The vibration system of claim 2, wherein the reinforcement structure comprises a first reinforcement structure and a second reinforcement structure provided on opposite sides of the vocalization film.

9. The vibration system of claim 8, wherein both the first reinforcement structure and the second reinforcement structure are made of copper foil.

10. The vibration system of claim 8, wherein the second reinforcement structure is electrically connected to a conductive terminal of the vibration system.

11. The vibration system of claim 8, wherein the first reinforcement structure comprises a first copper wire portion in a grid pattern at the vocalization area of the vocalization film.

12. The vibration system of claim 8, wherein the second reinforcement structure comprises a second copper wire portion formed by bending multiple times at the vocalization area of the vocalization film.

13. The vibration system of claim 1, wherein a thickness of the vocalization film is between 9 μm and 15 μm.

14. The vibration system of claim 1, wherein a thickness of the reinforcement structure is between 15 μm and 20 μm.

15. A panel speaker, comprising the vibration system of claim 1.

16. The panel speaker of claim 15, wherein the panel speaker further comprises a bottom case, one side of the bottom case is provided with an installation groove for installing the vibration system, and another side of the bottom case is provided with a guide pipe structure communicating with the installation groove.

17. An active noise reduction wearable electronic device, comprising the panel speaker of claim 15.

18. The active noise reduction wearable electronic device of claim 17, wherein the active noise reduction wearable electronic device is an active noise reduction earphone.

* * * * *